US005346203A

United States Patent [19]

Stemmle

[11] Patent Number: 5,346,203

[45] Date of Patent: Sep. 13, 1994

[54] HIGH CAPACITY SHEET STACKING SYSTEM WITH VARIABLE HEIGHT INPUT AND STACKING REGISTRATION

[75] Inventor: Denis J. Stemmle, Webster, N.Y.

[73] Assignee: Xerox Corporation, Stamford, Conn.

[21] Appl. No.: 113,004

[22] Filed: Aug. 30, 1993

[51] Int. Cl.[5] ..... B65H 39/10

[52] U.S. Cl. ..... 271/288; 270/53; 270/58; 271/296; 271/207

[58] Field of Search ..... 271/287, 288, 296, 298, 271/303, 207; 270/53, 58

[56] References Cited

U.S. PATENT DOCUMENTS

| | | | |
|---|---|---|---|
| 3,907,279 | 9/1975 | Ervin | 271/173 |
| 4,330,200 | 5/1982 | Kikuchi et al. | 271/288 |
| 4,344,614 | 8/1982 | Kaneko et al. | 271/288 |
| 4,361,320 | 11/1982 | Kikuchi et al. | 271/288 |
| 5,026,034 | 6/1991 | Russel et al. | 270/52 |
| 5,098,074 | 3/1992 | Mandel et al. | 270/53 |

FOREIGN PATENT DOCUMENTS

| | | | |
|---|---|---|---|
| 0093765 | 7/1980 | Japan | 271/296 |
| 0140297 | 6/1991 | Japan | 271/287 |

*Primary Examiner*—H. Grant Skaggs

[57] ABSTRACT

A high capacity sheet stacking system for stacking substantial quantities of the sequential sheet output of a reproducing apparatus on a sheet stacking tray providing an inclined sheet stacking surface at a substantial angle from the horizontal for receiving and registering sheets against an upstanding stack edge registration or alignment surface. Here, this stack edge alignment surface is automatically varied in height above the stacking surface with the change in stack height in the tray, in coordination with vertical repositioning of the sheet input level to the tray with stack height, so that an elevator system is not required for the stacking tray, and a simple fixed position tray may be used, yet high sheet stacking capacity provided.

10 Claims, 5 Drawing Sheets

HIGH CAPACITY SHEET STACKING SYSTEM WITH VARIABLE HEIGHT INPUT AND STACKING REGISTRATION

Cross-reference and incorporation by reference is made to copending, commonly assigned, U.S. application Ser. No. 08/054,943 by Barry P. Mandel and Richard A. Van Dongen, entitled "Mailbox/Compiler Architecture", and U.S. application Ser. No. 08/054,502, by Barry P. Mandel and David R. Kamprath, entitled "Shared User Printer Output Dynamic 'Mailbox' System", both filed Apr. 27, 1993.

The disclosed system provides improved output stacking of multiple printed sheets, such as multiple sets or jobs of flimsy copy sheets sequentially outputted by a copier or printer, with overall stack alignment for subsequent handling, particularly for large stacks, at relatively low cost, and without sacrificing desired inclined stacking and registration orientations. Further so disclosed is a stacking system that does not require a movable stacking tray with a tray elevator, and can provide a simple fixed stacking tray by providing a variable height stacking registration wall and a variable sheet input level to the stacking tray.

The disclosed sheet output stacking system has particular utility or application for high-capacity stacking of pre-collated copy output sheet sets from a copier or printer, which may include a compiler and finisher, where such output may require stacking relatively large numbers of completed copy sets in a relatively high stack. Such stacked copy sets may be unfinished, or may be stapled, glued, bound, or otherwise finished and/or offset.

High capacity stackers are particularly desirable for the collected output of high speed or plural job batching copiers or printers. High capacity stackers (usually with job offsetting) are also often used for the accumulated output of unattended plural user (networked) printers, of any speed.

The disclosed system provides a high capacity sheet stacking system for stacking substantial quantities of the sequential sheet output of a reproducing apparatus on a sheet stacking tray providing an inclined sheet stacking surface at a substantial angle from the horizontal for receiving and registering sheets against an upstanding stack edge registration or alignment surface. Here, this stack edge alignment surface is automatically varied in height above the stacking surface with the change in stack height in the tray, in coordination with vertical repositioning of the sheet input level to the tray with stack height, so that an elevator system is not required for the stacking tray, and a simple fixed position tray may be used.

The variable input level stacking system disclosed herein is particularly compatible or combinable with, or integrateable into, a plural tray or bin sorter or mailbox unit, wherein the variable level sheet input for the stacker can also be conventionally used as a bin or tray selector, so as to provide either selected bin stacking or high capacity tray stacking in the same integral output unit sharing common hardware for cost savings.

By way of background, as is well known in the art, and further discussed hereinbelow, for better stacking registration, it is desirable to sequentially deposit the outputted sheets onto an inclined surface. Initially this is the inclined sheet stacking surface of the empty stacking tray, and then it is the correspondingly inclined upper surface of the sheets previously stacked thereon. If the stacking tray surface is upwardly inclined relative to the sheet input into the tray, this is known in the art as "uphill" stacking. It is called "downhill" stacking if the stacking tray slopes downwardly away from the sheet input. There are many advantages to using either "uphill" or "downhill" stacking, either for stacking per se, or for stacking in a compiler for stapling or other binding or finishing. It allows different sizes of sheets to be stacked using the same paper path and the same tray system, using gravity assisted stacking against a simple inboard (see below) or outboard registration wall or surface, and therefore, is relatively less expensive than more complicated active stacking registration/alignment systems, such as those requiring scullers, flappers, tampers, joggers, etc., although the latter can be additionally provided for stacking and registration assistance.

"Uphill" stacking desirably lends itself to stacking registration at an inboard end or side of a reproduction machine and/or a connecting modular stacking unit. That is, at the sheet input side of the stacking tray. It thereby reduces cantilever forces on cantilevered stacking trays. It also automatically slows down the ejected sheets, due to their initial "uphill" movement. The sheets then reverse their movement to slide back down against an upstanding wall or edge adjacent to but underlying the sheet ejection slot or nip. Incoming sheets thus cannot stub on the end of the stack in the tray, if the further sheets enter above the top sheet of the stack, which of course rises with the stack level.

As noted above, it is well known in the art to provide a stacking system with a stack elevator [see art cited below]. Thereby the stacking tray is maintained at a suitable height for such stacking, by the stacking tray and all its contents being moved downwardly vertically as the stack therein accumulates, so that the top of the stack remains in the same general relative position below the sheet output. However, this requires a fairly powerful and an expensive tray elevator system.

Since such a movable stacking tray must move down for substantial distance to accumulate the stacking of a substantial number of stacked sheets, the stacking registration wall is normally a fixed vertical surface and not an integral upstanding end of the tray itself, as in a sorter bin or other conventional stacking tray. That is, the registration surface against which the incoming copy sheets are registered is typically the vertical surface of the end of the machine or the stacking tray elevator itself, against which the sets can register or align as they stack.

If, instead, a conventional registration end wall integral (and substantially perpendicular to) the stacking tray were provided (moving therewith), that registration wall would have to have a height equal to the full elevator travel range of the stacking tray. Otherwise, sheets stacked higher than that registration wall would slide off the stack. In the empty (fully raised) position of such a stacking tray, such a fixed height registration end wall would unacceptably extend well above the top of the machine, and/or block the sheet entrance to the tray if located on that end of the tray for "uphill" stacking.

Also, with such a tray designed for high capacity stacking, the first incoming sheets would be be required to drop a substantial distance before coming to rest on the top of the stack or tray. This large drop distance tends to increase the number of stacking problems, such as sheets or sets coming to rest in an orientation other than flat against the top of the stack, and/or substantial scatter within the stack.

Some examples of prior patents disclosing high-capacity stackers include Xerox Corporation U.S. Pat. No. 5,098,074, issued Mar. 24, 1992 to Barry P. Mandel, et al., and Eastman Kodak Company U.S. Pat. No. 5,026,034, issued Jun. 25, 1992 to Steven M. Russel, et al., and art cited therein. An integral or modularly related copy set compiler and stapler or other finisher is disclosed in said U.S. Pat. No. 5,098,074 and art therein.

Further by way of background on sheet stacking difficulties in general, outputted sheets are usually ejected into the stacking tray from above one end thereof. Normal output stacking is by ejecting sheets from above one end of the top sheet of the stack of sheets onto which that additional ejected sheet or sheets must also stack. Typically, each sheet is ejected generally horizontally (or slightly uphill initially) and continues to move horizontally primarily by inertia. That is, stacking sheets are not typically effectively controlled or guided once they are released into the stacking tray area. (Except in this author's orbital nip stacking system of U.S. Pat. No. 5,201,577, cited below.) The sheets fall by gravity into the tray to settle onto the top of the stack. However, sheet settling (falling) is resisted by the relatively high air resistance of the sheet to movement in that direction. Yet, for high speed reproduction machines output, sheet stacking must be done at high speed, so a long sheet settling time is undesirable. Thus, a long sheet drop onto the stack is undesirable.

The stacking of sheets is made even more difficult where there are variations in thickness, material, weight and condition (such as curls), in the sheets. Different sizes or types of sheets, such as tabbed or cover sheets or Z-folded or other inserts, may even be intermixed in the copy sets in some cases. The sheet ejection trajectory and stacking should thus accommodate the varying aerodynamic characteristics of such various rapidly moving sheets. A fast moving sheet can act as a variable airfoil to aerodynamically affect the rise or fall of the lead edge of the sheet as it is ejected. This airfoil effect can be strongly affected by curls induced in the sheet, by fusing, color printing, etc.. Thus, typically, a restacking ejection upward trajectory angle and substantial release height is provided, well above the stack height or level at the sheet ejection point. Otherwise, the lead edge of the entering document can catch or snub on the top of the sheet stack already in the restacking tray, and curl over, causing a serious stacking jam condition. However, setting too high a document ejection level to accommodate all these possible restacking problems greatly increases the sheet settling time for all sheets, as previously noted, and creates other potential problems, such as sheet scattering.

Sheet scatter within a stack has at least three negative consequences. First, if the stacker assembly has a sets offsetting feature, intended to provide job set separations or distinctions, scatter within a stack makes such set distinction more difficult. Secondly, a substantial stack within which individual sheets are not well aligned to each other is more difficult for an operator to grasp and remove from the stacker. Thirdly, a misaligned stack is not easily loaded into a box or other transporting container of corresponding dimensions.

Very importantly, it may be seen that a desired sheet ejection level should accommodate variations in the pre-existing height of the stack of sheets already in the tray (varying with the set size, sheet thickness, and number of sheets stacked in the tray since it was last cleared). Thus, as noted above, a tray elevator is normally provided to maintain a relatively constant stack height position relative to the sheet output ejection position for high capacity stackers.

This is especially so for small shelf or shared compiler shelf/tray compiler/set ejector, as taught in the above-cited 5,098,074. Those systems require the top of the stack to support the outer end of a set being compiled, and thus the stack height must be controlled relative to the compiler output for that reason as well.

Further by way of background, including the recognition of various such general problems of sheet restacking, examples of various stacking assisting devices are taught in U.S. Pat. No. 4,385,758 and Xerox Corporation U.S. Pat. Nos. 4,469,319; 5,005,821; 5,014976; 5,014,977; 5,033,731; and art therein. Sheet "knock down" or settling assistance systems are known, but add cost and complexity and can undesirably prematurely deflect down the lead edge of the ejected sheet. Also, such "knock down" systems can interfere with sheet stack removal or loading and can be damaged thereby. Also, stacking systems should desirably provide relatively "open" trays, which will not interfere with open operator access to the output stacking tray or bin, for ease of removal of the sheet stack therein.

Since the stacking system disclosed herein is particularly combinable with sorters or "mailbox" systems, by way of background, extensive "mailbox" background and prior art is discussed in the two above-cited cross-referenced applications. As noted there, Xerox Corporation printer mailbox products using locked sorter bins predate Xerox Corporation EP No. 241,273 published Oct. 14, 1987. Use of sorters as either sorters or user-mailboxes for printers is discussed, e.g., in Gradco U.S. Pat. No. 4,691,914, issued in 1987 and U.S. Pat. No. 4,843,434 filed in 1987, and also noted in Canon Takahashi U.S. Pat. No. 4,051,519, filed in 1981. Putting more than one finished (stapled) set in a selected mailbox bin from a partially shared short shelf compiler is disclosed in B. Mandel Xerox Corporation U.S. Pat. No. 5,098,638, issued in February, 1992, noted above. Removing and changing the spacing of bins to change the bin capacity is described in U.S. Pat. No. 3,907,279. Also, there is other extensive prior art on sorters with "overflow" trays or "common" trays of much higher capacity than the sorter bins. E.g., U.S. Pat. No. 4,872,662, which also shows plural (ganged) sorter interconnections.

The system disclosed herein overcomes the above and other problems, without requiring a tray elevator, yet without sacrificing the desired output and stacking positions for the outputted sheets.

As to specific hardware components which may be used with the subject apparatus, or alternatives, it will be appreciated that, as is normally the case, various suitable such specific hardware components are known per se in other apparatus or applications, including the cited references and commercial applications thereof.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of embodiments thereof, including the drawing figures (approximately to scale) wherein:

Figure 4:
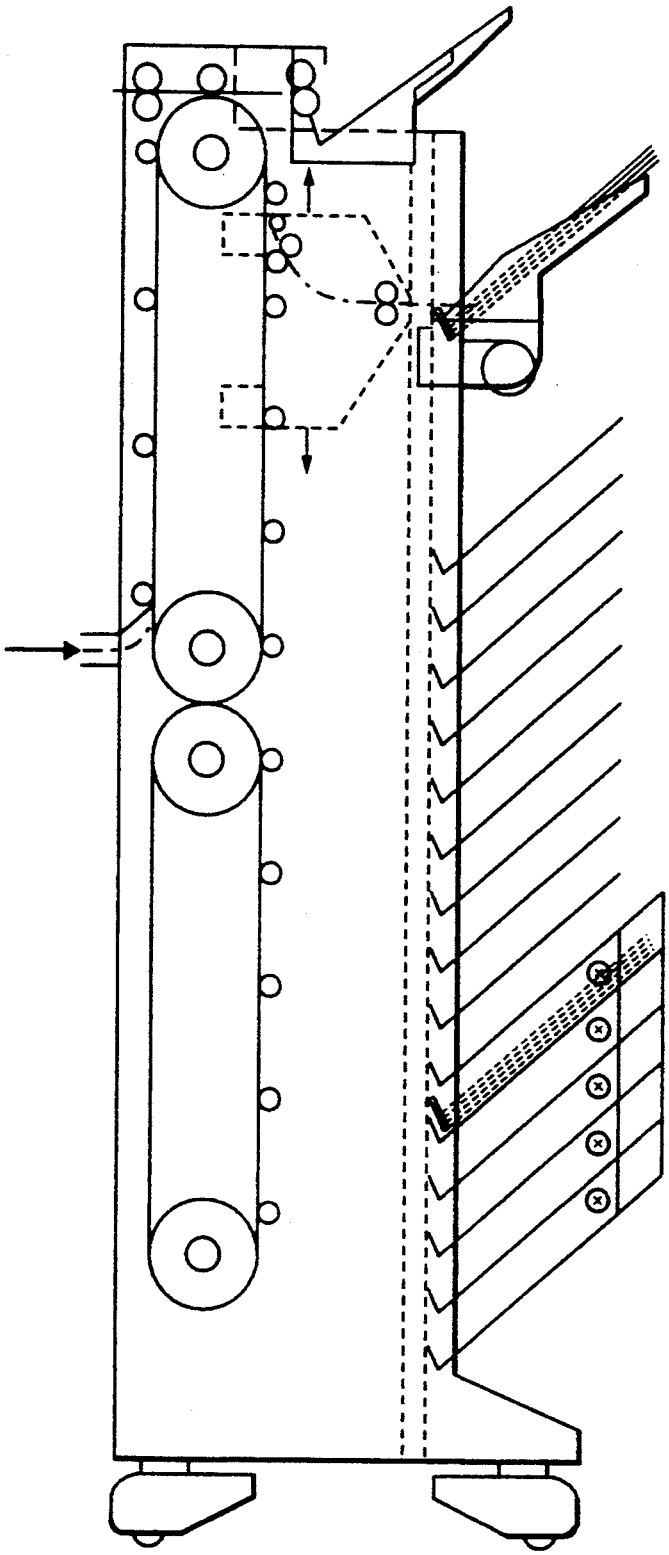
Figure 5:
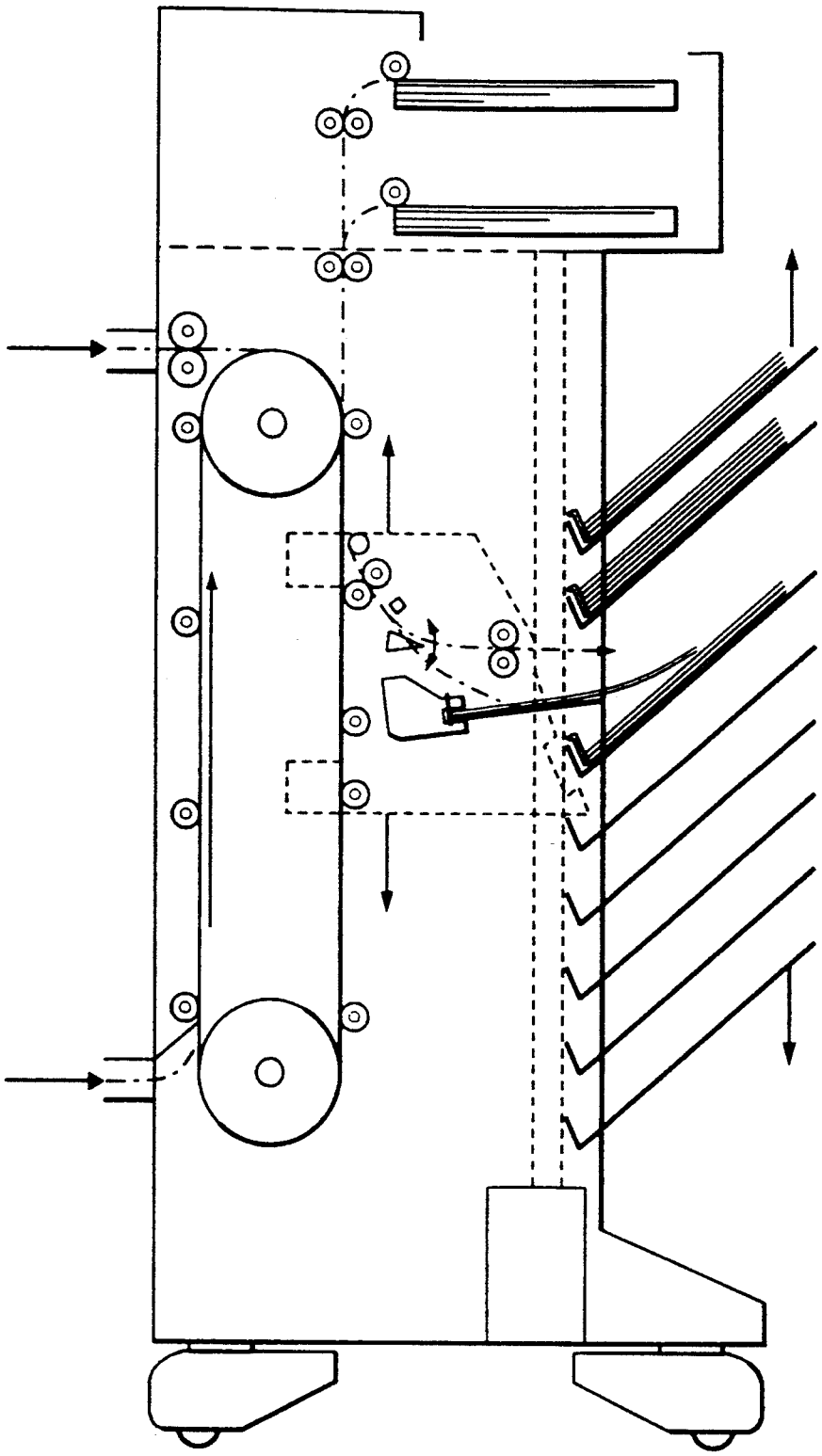

FIG. 4 is an overall schematic view of an integral multi-function module with mailbox bins and a high capacity stacker, also illustrating an exemplary vertically repositionable compiler/stapler/set ejector for selectively feeding sheets to either, from the above-cited copending cross-referenced application; and FIG. 5 shows another said sorter or mailbox/stacker module, with a somewhat different moving compiler unit shown ejecting a set into a repositionable bin.

The present invention is not limited to the specific embodiments illustrated herein. The specific exemplary embodiments disclosed show "uphill" high-capacity stacking trays with an inclined stacking surface at a desired stacking angle to the horizontal, which stacking tray or trays may be an integral part of a multi-bin sorter or mailbox unit. That unit or module may also provide other conventional, low capacity trays with conventional fixed low height registration end walls. The stacking tray here has a sheet stacking registration wall at the inside, lower, end of the stacking surface which is approximately perpendicular to the stacking surface. It may be at a more acute angle than that for space savings reasons, as shown, so as not to interfere with vertical movement of a sheet input system therepast, and allow the sheet input to be closely adjacent the downstream end of the stacking tray.

Figure 1:
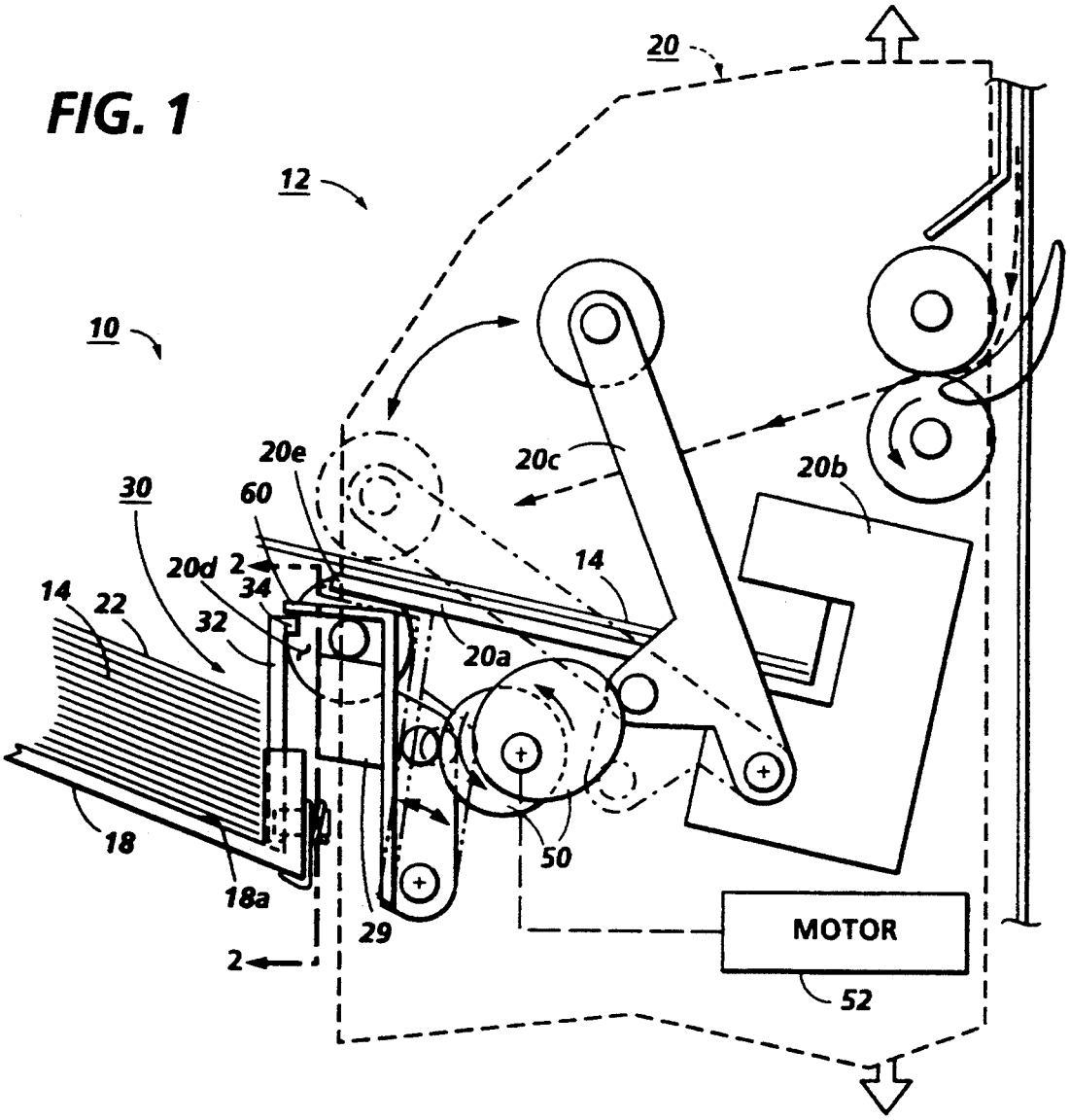
FIG. 1 is a partial schematic front view of one exemplary copy sheet output system incorporating one example of the present high capacity fixed tray stacking system, as it may be incorporated into a mailbox system sharing an illustrated vertically movable compiler and set ejector system.
Figure 2:
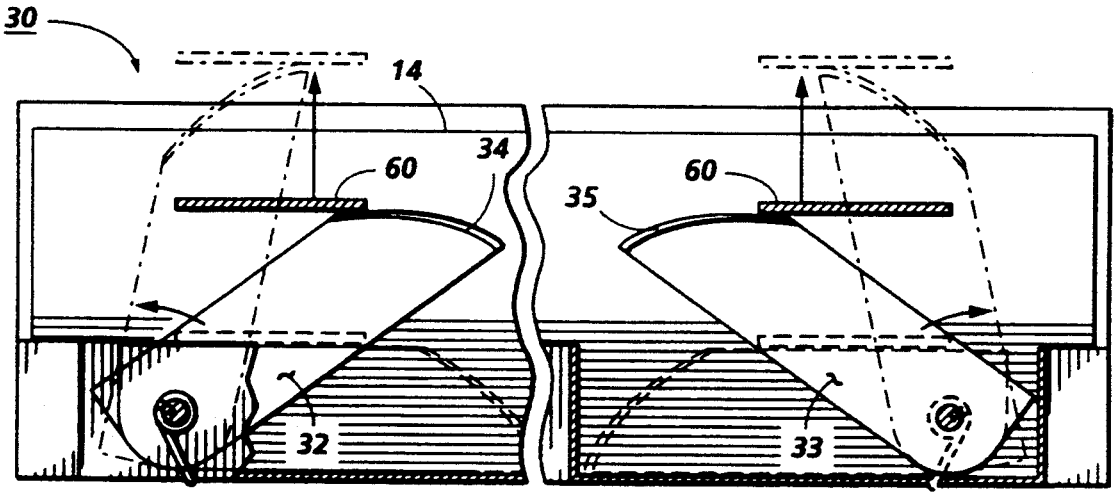
FIG. 2 is a partial cross-sectional view taken along the line 2—2 of FIG. 1, to more clearly illustrate the exemplary vertically repositionable tray end wall members, providing an automatically variable height stack edge registration and retention system.

Referring particularly to FIGS. 1 and 2, there is shown one example 10 of the subject variable height registration wall sheet stacking system. A somewhat different exemplary stacking system 11 is shown in two examples in FIG. 3. This stacking system 10 may be part of a "mailbox" module 12, with plural mailbox bins, receiving outputted copy sheets 14 from a printer. However, the system 10, 11, or the like, could be in various other stackers, sorters, compiler/finisher units, or other output modules, or integral the printer itself. The stacking system 10 or 11 or the like may also be a self-contained, stand-alone or independent high capacity stacking unit, wheeled up to and docked with any reproduction apparatus, when desired.

This stacking system 10 or 11 here has at least one "uphill" stacking tray 18 with a sheet input 20 indirectly from a printer to provide improved output sheets 14 stacking and control. This stacking system 10 or 11 is a high-capacity type stacker system. That is, the sheet receiving and stacking system 10 can stack a large number of the sheets 14 into tray 18 in a neat, registered, high stack 22 of stacking surface 18*a*. The upstream end of the tray 18 is closely adjacent the sheet input 20, for being fed sheets, or sets of sheets, for stacking.

The exemplary stacking system 10 may utilize an otherwise conventional fixed copy sheet output tray as stacking tray 18, since no tray elevator system is required. Here the sheet input 20 is vertically movable instead. It may be mounted in a linear, vertical, elevator track to be moved by any suitable elevator drive system or lift mechanism, such as a servo or stepper motor, to provide a moving sheet input 20 for the accumulating stack of sheets in the stacking tray unit 14.

Various suitable elevator mechanisms known and/or shown in the art for moving stacking trays may be used here instead to move the sheet input system 20. These include the above-cited EK U.S. Pat. No. 5,026,034, FIG. 2, Xerox Corporation U.S. Pat. No. 4,925,171; Canon Corp. U.S. Pat. No. 5,137,265; Norfin, Inc. U.S. Pat. No. 3,414,254 cited below, etc.. It may be a cable, ratchet, lead screw, parallelogram linkage, or other suitable elevator movement mechanism. A detailed vertical elevator drive system is also shown and described in the above-cited U.S. Pat. No. 5,098,074 by Barry Mandel, in Columns 5–6, inter alia.

The moveable sheet input 20 here is a vertically repositionable compiler, stacker/stapler/set ejector known per se and described in the above-cited applications, etc., and thus need not be described in detail. If there is more than one tray, the desired tray 18 may be selected by the vertical position of the compiler unit 20. Sheets are deflected from a conventional vertical sheet transport by a deflector and input rollers nip, as shown by the dashed line with arrow, into a partial compiler shelf 20*a*, where the sheets 14 are compiled into job sets, and stapled at 20*b*. The set is then ejected by arm 20*c* (with an end roller), pivoting down to form an ejecting nip with underlying roller 20*d* to feed the compiled set off the compiler shelf 20*a* into the tray 18 Here, the compiler shelf 20*a* end 20*e* determines the set ejection level. As shown in FIG. 1, arm 20*c* may be pivoted by a cam 50 driven by motor 52. The FIG. 5 example uses a different set ejector with ejector fingers, like that of the above-cited U.S. Pat. No. 5,098,074, etc.

However, the movable sheet input 20 can be much lighter than the weight of a stacking tray loaded with a large stack of copy sheets. The tray 18 here does not need to move. Thus, a simple, lighter, cheaper and faster elevator system can be used here than for a conventional moving tray stacker system.

As noted above, the movable sheet input unit 20 can be a simple moving gate sheet deflector as in said U.S. Pat. No. 3,414,254, or a moving compiler/stapler unit such as 20, as described in the above-cited co-pending applications and references. In either case, the sheet input level to the stacking tray 18 automatically rises vertically as the top of the stack rises, (as the tray 18 fills) by repositioning the sheet input unit 20.

As taught in various of the cited references, it is known to operate such an elevator system by incrementally controlling it via a conventional microprocessor controller with stack height input from a conventional stack height sensor, such as 29, as in said Xerox Corporation U.S. Pat. No. 5,098,074 or 5,033,731. Here, instead of moving tray 18, such controls maintain the sheet input 20 repositioned at a relatively constant distance above the top of the stack 22, as the sheet stack top level tries to move up toward the vertical position of the input 20. That is, here the set ejection end 20 of the compiler tray 20*a* is maintained at a suitable level above the top of the stack 22 in tray 18. This automatic sheet input unit 20 repositioning as the stack 22 accumulates is illustrated by the associated movement arrows here. If the sensor 29 arm indicates that the stack being detected is too far below the input level 20, the input unit 20 will be moved down automatically. This can occur when some sets are removed from stack 22, or the tray 18 is emptied.

If no direct stack height sensor 29 control is desired, the control logic in a conventional controller can be used to count the total number of outputted sheets since the tray was last emptied, to provide an approximate determination of the stack 22 height, and provide corresponding repositioning control signals in response thereto. In either case, these stack height signals may be fed here to a stepper motor drive to effect a corresponding change in sheet input 20 height.

Figure 3:
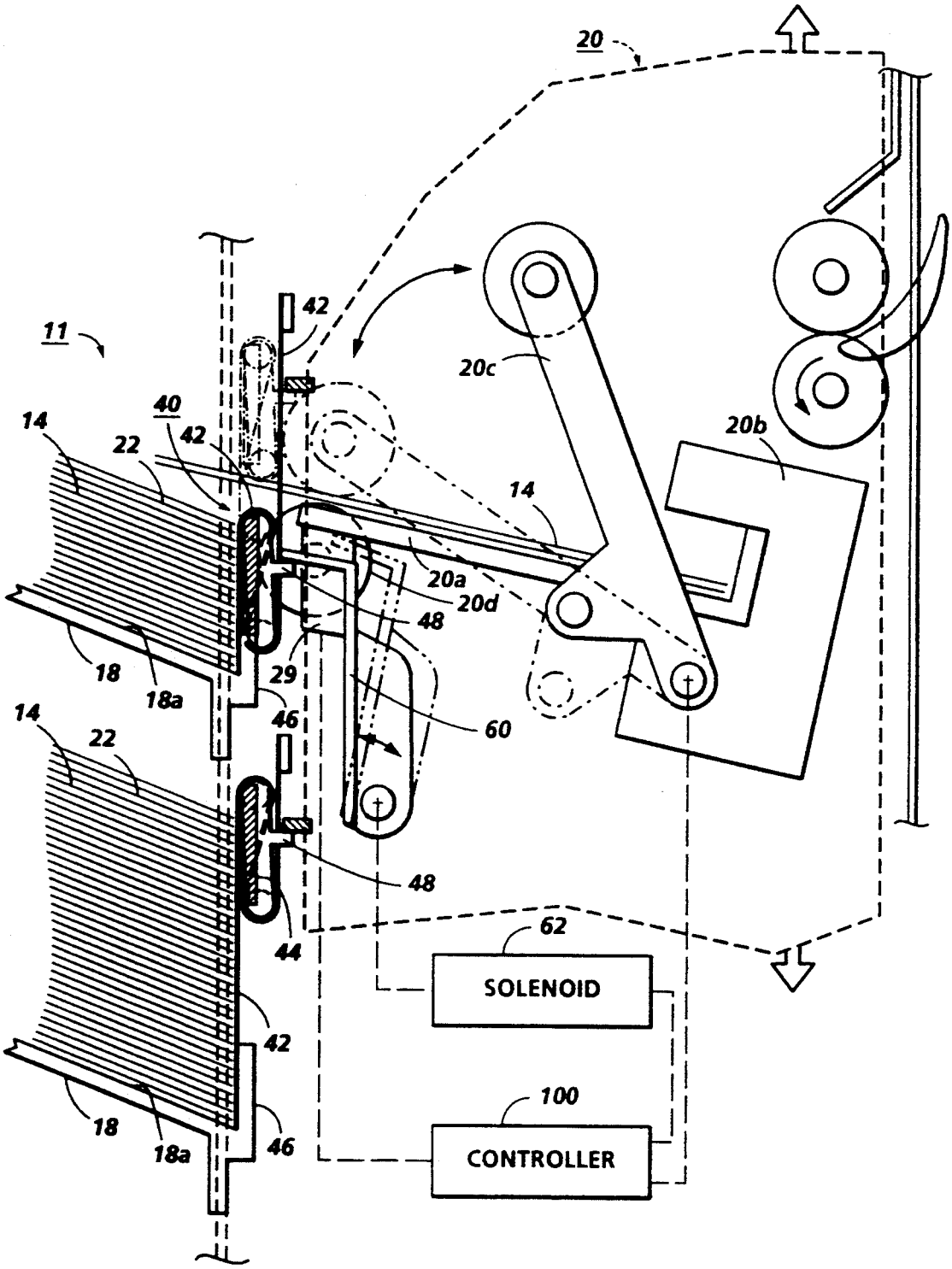
FIG. 3 is another embodiment or example of the subject high capacity stacking system, with the same exemplary vertical sheet transport and moving sheet deflector/compiler/set ejector example as in FIG. 1, but with two stacking trays illustrated, and with a partially supported flexible belt extending stack wall in each tray providing the variable height stack edge registration and retention system.

The exemplary embodiments 10 and 11 here have stacking trays 18 providing an inclined stacking surface 18*a* at a desired stacking angle from the horizontal sufficient to slide stacking sheets down against the upstanding sheet stacking registration edge, surface or end wall at the lower end of the stacking surface 18*a*. The variable height end wall system 30 example is shown in FIGS. 1 and 2, and the system 40 example is shown in FIG. 3. The stacking system 30 or 40 here registers each incoming (top) sheet, maintains edge alignment or squaring of the entire stack end, and keeps any part of the stack 22 from sliding off the tray 18, even as the stack 22 greatly increases in height.

This stacking edge alignment system 30 or 40 is not fixed in height here, as in a conventional tray stacking system. It moves to increase in height automatically to stay above the top of the stack 22, while keeping a constant relationship with the sheet input 20. That is, the stack registration and edge alignment system 30 or 40 herein provides high capacity "uphill" set stacking into a fixed tray by providing a movable "backstop" (or bin rear registration edge) which moves up (increases in height) with the moving sheet input level. I.e., the backstop system 30 or 40 moves up the back of the stack as the stack height increases and the compiler moves up.

In the example 30 of FIGS. 1 and 2, elongated rigid backstop registration arms 32, 33 are pivotally mounted to tray 18, or its mounting frame, and spring loaded to pivot up transversely of the tray 18 as the compiler or other sheet input 20 rises relative to this fixed tray 18 (as the stack level rises). These arms 32, 33, or the like, and their mountings, provide sufficient rigidity to provide a consistent downhill end registration wall or edge even for heavy (high) stacks. They provide a variable height registration wall system 30 for a high capacity stacking system. This pivotal movement of arms 32, 33 can be somewhat like windshield wipers or scissors. Note the movement arrows in FIG. 2. The arms 32, 33 may be longer than those illustrated, and may even cross each other when held down, to increase the maximum stacking capacity.

These pivotal stack end retainers 32, 33 desirably automatically stay up with a stack there against so as not to require stack unloading before moving the sheet input unit 20 (compiler or input gate) down again. However, the arms 32, 33 should be movable down, e.g., by the sheet input unit 20 when the tray 18 is empty or substantially empty, so the sheet input 20 will not be too high above the tray bottom surface 18*a* for the start of stacking, as discussed above.

Various means may be used to control the height of the stack edge alignment system 30 by the repositionable sheet input level unit 20. Referring particularly to FIG. 2, as well as FIG. 1, a cam 50 driven by motor 52 moves a pivotal latch 60, both mounted to the sheet input unit 20. In a first position (shown in solid lines), the latch 60 engages tabs 34 and 35 respectively on arms 32 and 33. As the sheet input unit 20 moves down towards the tray prior to stacking, the tabs 34 and 35 push the arms 32, 33 down to a position determined by the position of the sheet input unit. As the height of the stack increases (as detected by stack height sensor 29), the sheet input unit 20 moves upward. The arms 32, 33 remain spring loaded against latch 60 as the sheet input unit 20 moves upward, thereby automatically extending the arms 32, 33 to accommodate an increasingly higher stack.

In a second position shown in phantom lines in FIGS. 1 and 2, cam 50 causes latch 60 to retract, to thereby remove its contact with tabs 34 and 35 on arms 32 and 33. In this situation, the spring load on arms 32 and 33 rotates them to their highest, most vertically extended (e.g., 75–80 degree), positions. This second position of latch 60 allows sheet input unit 20 to move on to the next lower tray. Latch 60 is retracted by cam 50 only for a short time to release the spring loaded arms on the first tray, then moved back to its initial position so as to engage tabs 34 and 35 on the next lower tray. [Only one tray is shown in FIGS. 1 and 2.]

Turning now to the alternative embodiment stacking system 11, with a different variable height registration wall system 40, of FIG. 3, it also provides high capacity "uphill" set stacking into fixed trays or bins 18. The system 40 is providing a flexible "backstop" 42 (or bin rear registration surface) which moves up (increases in height) with the moving compiler/set ejector unit 20. I.e., the backstop 42 here is a flexible belt (or belts) that unrolls up the back of the stack as the stack height increases and the compiler unit 20 moves up. Two identical such systems for two identical such high capacity stackers 18 are shown in FIG. 3 in one unit.

The flexible belt backstop 42 here is partially supported or backed up with a rigid frame member or backing plate 44 attached to and moving with the belt 42 traveling carriage to support the weight of the upper portion of the stack, as illustrated in FIG. 3. This backing plate 44 slides up the back side of the belt 43, which should be a low friction material. As the stack achieves a certain height, the backing plate member 44 no longer backs up the portion of the stack below the member 44. That is not necessary at that point, since the lowest portions of the stack are restrained from sliding downhill by a rigid rear wall portion 46 of the tray, and the top of the stack is prevented from sliding downhill (and thereby restrained from "bowing" the windowshade) by the aforementioned rigid frame member 44 of the windowshade support carriage. The middle (unbacked) portion of the stack will not slide downhill because there is substantial sheet to sheet friction and substantial normal force from the portions of the stack piled above that central section of the stack.

As further shown in FIG. 3, the flexible backstop stacking mechanism of system 11 automatically stays out of the way of incoming sheets. It is affixed to the sliding carriage 20, which supports two rollers that define the shape of the flexible backstop 42. This is not a "windowshade" mechanism. It is a flexible belt 42 with both ends fixed. It is more akin to a "Rolomite" bearing than to a windowshade. A major benefit of this geometry and mechanism is that the backstop 42 does not slide relative to the edge of the stack as would happen with a windowshade (unless it were unrolled from above the stack). Rather, the backstop 42 is rolled up against the edge of the stack, so that there is no sliding motion. The two rollers on the sliding carriage simply bend the belt into the shape of an "S" laying on its side. As the sliding carriage moves up or down, the location of the S-bend moves with it. The top anchored portion of the belt 42, which is always located on the right side of the sliding carriage, has a large rectangular hole in it to allow sheets to pass through the belt. The bottom anchored portion of the belt 42, which may always be located to the left of the carriage and partially snaked through the carriage in the "S" path, is preferably solid (unapertured) in order to function as a backstop for any size sheets as the stack grows and the carriage elevates. Of course, various other mechanisms or modifications will be available to those skilled in the art.

To express it another way, an advantage of this flexible belt 42 version 40 of the variable height registration stacking wall is that as the belt 42 unrolls to accommodate increasing stack height, there is no relative motion between this backstop member 42 and the registered edge of the stack. Thus, there are no forces to lift the edge of the stack, or disturb it in any other way. This will help keep the stack edge flat and neat. Also, the height of the stack is limited only by the length of the belt selected, and/or its unscrolling system.

In the FIG. 3 example, the latch 60 is operated by a solenoid 62 rather than a rotating cam 50 as in FIGS. 1 and 2. However, the activation or timing (by the existing controller) may be similar to that described previously. Set ejector arm 20*c* may also be solenoid activated, if desired. The pivoted latch arm 60 is shown otherwise similarly provided under the compiler shelf 20*a* on the traveling elevator carriage assembly 20. Here, in its forward or downstream position, the operative end of the latch arm 60 engages and holds the backstop control tabs 48, allowing them to move up only with the upward movement of the carriage assembly 20.

To recapitulate, the stacker problems addressed by this system are very real ones. A fixed stacking tray with a high fixed end wall would be impractical for a high capacity stacker, which does not have a tray elevator for moving the tray down as it fills. A compiler or other tray input can't feed into the tray if the registration end wall is too high and in the way (blocking sheet input). Also, if the tray end wall is too high and the compiler/ejector or other sheet input feeds in over the top of a high end wall into an empty bin, the first ejected sets would have too far to drop, and could be scattered or disoriented or even buckled or folded over. A shared (partial) compiler shelf/stack support compiling system, as Mandel U.S. Pat. No. 5,098,074 or Canon U.S. Pat. No. 5,137,265, could not then be used, either since the compiling set outer end would hang down too far, or even pull off of the short compiler shelf. As noted above, such "shared" compiler tray systems require the top of the stack to be maintained adjacent the compiler shelf level to help support the compiling set. Normally, that is done by moving the tray down as it fills. Here, the compiler or other input feeder moves up as the tray fills, and so does the stack registration end wall, with the tray input, but under it.

As noted, an integral or related copy set compiler/-stapler or other finisher can desirably be provided prior to stacking. It can be integrated with the vertically repositionable sheet input 20 to the stacking tray 18. Such units, per se, are disclosed in the above-cited U.S. Pat. No. 5,098,074, issued Mar. 24, 1992 by Barry P. Mandel, et al., for example, or the above-cited U.S. Pat. No. 5,201,517. Other compiler/staplers are shown in Xerox Corporation allowed U.S. application Ser. No. 07/888,091 filed May 26, 1992 by Barry P. Mandel, et al., and Canon U.S. Pat. No. 4,883,265, 5,137,265 and EPO No. 346 851. However, here such a compiler/finisher unit, if provided, is desirably vertically movable directly adjacent to the stacking tray, as disclosed in the two above cross-referenced copending applications, and further illustrated herein.

However, as noted, and also illustrated herein, the automatic variable height stacking end wall system 30 or 40 here is equally or even more usable with a fixed tray stacker combined into a simple fixed bins moving gate type sorter, where no moving compiler is required. (See, e.g., the Norfin Co. (Snelling, et al.) expired U.S. Pat. No. 3,414,254.) It is known to provide stationary bin sorters with an additional common, top, or stacking tray. However, they are usually relatively limited in capacity or stacking registration. Such sorters can, however, optionally provide in-bin stapling, as is well known.

Further on this point, as shown in such references, a moving gate for a sorter can be very light-weight, simple, vertically repositionable sheet deflector taking sheets from a vertical sorter transport wherever it is vertically positioned to deflect the sheets into the adjacent selected sorter bin. Thus, using a compiler/stapler/set ejector unit for both a mailbox for a printer and for sorter (collator) (for a non-pre-collation copier) is probably not cost effective, as sorters can be made cheaper and faster if they do not have to provide a heavier and larger compiler unit and its elevator to move rapidly vertically between bins to put only one sheet into each bin at a time, as is required for sorting. Also, in sorter operations, even if stapling is desired, since there is only one set per sorter bin, simpler, well-known in-bin stapling systems can be used. Many examples are listed in said cited first paragraph cross-referenced applications. That is, the compiling as well as stapling can be done in the sorter bins themselves rather than in a separate compiler/stapler, since there is no need to put plural stapled sets into the same bin (unlike a mailbox).

Although copy sheet output stacking is described herein, it will be appreciated that there may be extended applications for the present concept, such as for use for a document "job batching" restacker, for accumulating several job sets of original documents and restacking them after plural sequential unattended document copying or scanning jobs have been completed.

Although a desired "uphill" stacking system is illustrated herein, with registration at the inside of the stacking system, the concept here could be extended to a copier or printer output system with a "downhill" (or even horizontal) set registering compiler/finisher or the like, ejecting sheets or sets of sheets into a downhill stacker with an outside instead of an inside movable registration end wall.

The sheet input 20 may have output or exit ejection feed rollers and/or a deflector extending out slightly over (beyond, or downstream of) the plane of registration wall system 30. The lower exit rollers shaft may also desirably include known flexible sheet flappers. This helps control upcurled sheet ends in uphill stacking. In that case, the input 20 elevator system may be controlled to keep the top of the stack relatively close to the lower sheet ejection rollers or said flappers effective are to help keep the stacked sheets pressed down and preventing them from "climbing" up the registration wall 30 or 40.

Although not relevant to the disclosed system, it is noted that, conventionally, when a compiler/stapler station is utilized, a side tamper may also be provided to tamp each set into the corner compiling for corner stapling with the stapler unit, and then the stapled set may be offset before the ejection of the stapled set into the stacker tray. Other known lateral or side edge registration systems may be provided compatibly with the present systems.

The present system may be optionally combined with an orbiting nip (or other) optional sheet output inverter and/or plural mode output, etc., as disclosed by the same Denis Stemmle in commonly assigned U.S. Pat. No. 5,201,517 issued Apr. 13, 1993, entitled "Orbiting Nip Compiler for Faceup or Facedown Stacking".

While the embodiment disclosed herein is preferred, it will be appreciated from this teaching that various alternatives, modifications, variations or improvements therein may be made by those skilled in the art, which are intended to be encompassed by the following claims:

What is claimed is:

1. A high capacity sheet stacking and registration system for stacking output sheets of a reproduction apparatus in at least one stacking tray wherein said stacking tray is inclined so that sheets stacked therein move towards a stacking end for stacking registration; comprising:

a vertically repositionable sheet input feeder for feeding sheets into said stacking tray for stacking therein;

said sheet input feeder being vertically movable upwardly with increasing stack height in said stacking tray to change the vertical position at which it feeds sheets into said stacking tray in correspondence with said increasing stack height;

and a vertically repositionable sheet stacking registration edge adjacent said stacking end of said inclined stacking tray;

said vertically repositionable sheet stacking registration edge being operatively controlled in coordination with said vertically repositionable sheet input feeder to increase the effective height of said stacking registration edge as the stack height in the stacking tray increases without interfering with the continuing feeding of further sheets into said stacking tray by said vertically repositionable sheet input feeder.

2. The high capacity sheet stacking and registration system of claim 1, wherein said stacking tray is fixed rather than being moved down by an elevator as the sheet stack height therein increases.

3. The high capacity sheet stacking and registration system of claim 1, wherein said vertically repositionable sheet stacking registration edge comprises rigid arms pivotally mounted relative to said stacking tray, said pivotal rigid arms being adapted to rise vertically above said stacking tray but normally being maintained at least partially folded down by said vertically repositionable sheet input feeder under the position at which said input feeder is feeding sheets into said stacking tray, said arms automatically pivoting upwardly to increase said sheet stacking registration edge in height with upward movement of said sheet input feeder.

4. The high capacity sheet stacking and registration system of claim 1, wherein said vertically repositionable sheet input feeder is a compiler/finisher/set ejector unit for compiling, fastening together, and then ejecting, a set of plural sheets into said stacking tray to stack as multiple sets of fastened sheets.

5. The high capacity sheet stacking and registration system of claim 4, wherein said stacking tray is integral with a mailboxing system with a vertical array of plural mailbox bins, and said stacking tray is vertically aligned with said array of mailbox bins, and said compiler/finisher/set ejector unit is vertically movable to feed sets of sheets to either said stacking tray or selected said mailbox bins.

6. The high capacity sheet stacking and registration system of claim 1, wherein said stacking tray is mounted in a plural bin unit which has a substantially vertical sheet transport for sequentially transporting sheets past said bins and relative to said vertically repositionable sheet input feeder; and wherein said vertically repositionable sheet input feeder comprises a vertically repositionable unit operatively engaging said vertical sheet transport to feed sheets from said vertical sheet transport selectably into a selected said bin or into said stacking tray from a variable vertical position selected by said moving unit.

7. The high capacity sheet stacking and registration system of claim 6, wherein said vertically repositionable sheet stacking registration edge comprises rigid arms pivotally mounted relative to said stacking tray, said pivotal rigid arms being adapted to raise vertically above said stacking tray but being maintained at least partially folded down by said vertically repositionable sheet input feeder under the position at which said input feeder is feeding sheets into said stacking tray so as to increase said sheet stacking registration edge in height with upward movement of said input feeder but not interfere with its feeding of sheets into said stacking tray; and wherein said vertically repositionable sheet input feeder moves said pivotal stack registration arms upwardly when it moves upwardly, but not when it moves downwardly unless said stacking tray is substantially empty.

8. The high capacity sheet stacking and registration system of claim 1, wherein said vertically repositionable sheet stacking registration edge comprises a flexible backstop member which is unrolled to increase in height relative to said stacking tray.

9. A high capacity sheet stacking apparatus for stacking output copy sheet sets received from the sheet output of a reproduction machine comprising:

an output sheet stacking tray providing a sheet stacking surface inclined at a substantial angle to the horizontal for receiving sheets to be stacked thereon from said reproduction machine;

a sheet input system for feeding sheets into said sheet stacking tray to provide an increasing stack height thereon;

a stack edge registration unit providing an upstanding sheet edge registration surface against which the edges of said output sheets being stacked in said stacking tray are registered by sliding down said inclined angle to abut against said sheet edge registration surface;

and an elevator system for vertically repositioning said sheet input system relative to said stacking tray above said stack height so as to accommodate the stacking of multiple output copy sheets of said increasing stack height on said sheet stacking surface without interfering with said feeding of further output sheets from said sheet input system into said stacking tray;

wherein said stack edge registration unit is automatically adjusted in coordination with said increasing stack height to increase the height of said sheet edge registration surface above said stack height in said stacking tray.

10. The high capacity sheet stacking apparatus of claim 9, wherein said sheet stacking tray is mounted in a multi-bin sorter which has a substantially vertical sheet transport for sequentially transporting sheets past said bins and past said vertically repositionable sheet input system; and wherein said vertically repositionable sheet input system comprises a unit vertically repositionable by said elevator system and operatively engaging said vertical sheet transport to deflect sheets away from said vertical sheet transport selectably into a selected said sorter bin or into said stacking tray from a vertical position selected by said elevator system.

* * * * *